US006334635B1

(12) United States Patent
Huang

(10) Patent No.: US 6,334,635 B1
(45) Date of Patent: Jan. 1, 2002

(54) LATCH BOLT MECHANISM OF A TUBULAR LOCK WITH ADJUSTABLE BACKSET BY AN EXTENSION CASING

(75) Inventor: Chao Ming Huang, Kaohsiung Hsien (TW)

(73) Assignee: Taiwan Fu Hsing Industrial Co., Ltd., Kaohsiung Hsien (TW)

( * ) Notice: Subject to any disclaimer, the term of this patent is extended or adjusted under 35 U.S.C. 154(b) by 20 days.

(21) Appl. No.: 09/631,689

(22) Filed: Aug. 2, 2000

(30) Foreign Application Priority Data

Sep. 22, 1999 (TW) ..... 088216295

(51) Int. Cl.[7] ..... E05C 1/00

(52) U.S. Cl. ..... 292/1.5; 292/1; 292/337; 292/169.13; 292/169.14; 292/169.16; 292/DIG. 60; 292/348; 292/336.3

(58) Field of Search ..... 292/1.5, 1, 337, 292/169.16, 169.13, 169.14, DIG. 60, 348, 336.3

(56) References Cited

U.S. PATENT DOCUMENTS 4,427,224 A * 1/1984 Bergen ..... 292/169.23
4,711,477 A * 12/1987 Fann et al. ..... 292/169.14
4,746,154 A * 5/1988 Fang ..... 292/337
4,850,626 A * 7/1989 Gallego ..... 292/337
4,890,871 A * 1/1990 Lin ..... 292/337
4,927,199 A * 5/1990 Wu et al. ..... 292/337
5,020,837 A * 6/1991 Lin ..... 292/169.13
6,030,008 A * 2/2000 Chang ..... 292/1.5
6,257,630 B1 * 7/2001 Huang ..... 292/1.5
6,293,597 B1 * 9/2001 Huang ..... 292/1.5

* cited by examiner

*Primary Examiner*—B. Dayoan
*Assistant Examiner*—Carlos Lugo
(74) *Attorney, Agent, or Firm*—Bacon & Thomas

(57) ABSTRACT

A latch bolt mechanism of a tubular lock allows adjustment in backset by using an extension casing. The latch bolt mechanism has a latch bolt housing having a latch bolt mounted therein, the latch bolt being movable beyond a face plate or retracted into the face plate. Two plates are connected together and mounted to an inner end of the latch bolt. The plates includes aligned two first positioning holes, aligned second positioning hole, and aligned openings. An actuating plate is mounted between the plates and includes an end operably connected to the latch bolt. The other end of the actuating plate includes two teeth each having a block formed thereon. The blocks are pressed against by a follower plate that also includes two teeth. When either tooth of the actuating plate or the follower plate is pressed against by a spindle of the lockset, the latch bolt is retracted. An extension casing is mounted around the plates and movable toward or away from the latch bolt housing. The extension casing includes a first hole and a second hole through which the spindle of the lockset is selectively extended.

3 Claims, 5 Drawing Sheets

LATCH BOLT MECHANISM OF A TUBULAR LOCK WITH ADJUSTABLE BACKSET BY AN EXTENSION CASING

BACKGROUND OF THE INVENTION

1. Field of the Invention

The present invention relates to a latch bolt mechanism of a tubular lock that is adjustable in backset by using an extension casing.

2. Description of the Related Art

Many devices have been proposed to allow adjustment in backset of a lockset such that the lockset can be used with either one of two kinds of backset configuration in the structure of traditional latch bolt mechanism—namely, a 2⅜ inch type and a 2¾ inch type. An example of backset-adjustable latch bolt mechanisms is disclosed in U.S. Pat. No. 4,711,477 issued to Fann et al. on Dec. 8, 1987. The present invention is intended to provide a different design in this regard.

SUMMARY OF THE INVENTION

It is an object of the present invention to provide a latch bolt mechanism of a tubular lock that is adjustable in backset in response to the user's need by using an extension casing.

A latch bolt mechanism of a tubular lock in accordance with the present invention allows adjustment in backset by using an extension casing. The latch bolt mechanism has a latch bolt housing having a latch bolt mounted therein, the latch bolt being movable beyond a face plate or retracted into the face plate. Two plates are connected together and mounted to an inner end of the latch bolt. The plates includes aligned two first positioning holes, aligned second positioning hole, and aligned openings. An actuating plate is mounted between the plates and includes an end operably connected to the latch bolt. The other end of the actuating plate includes two teeth each having a block formed thereon. The blocks are pressed against by a follower plate that also includes two teeth. When either tooth of the actuating plate or the follower plate is pressed against by a spindle of the lockset, the latch bolt is retracted. An extension casing is mounted around the plates and movable toward or away from the latch bolt housing. The extension casing includes a first hole and a second hole through which the spindle of the lockset is selectively extended.

Other objects, specific advantages, and novel features of the invention will become more apparent from the following detailed description and preferable embodiments when taken in conjunction with the accompanying drawings.

DETAILED DESCRIPTION OF THE PREFERRED EMBODIMENTS

Preferred embodiments in accordance with the present invention will now be described with reference to the accompanying drawings.

Figure 1:
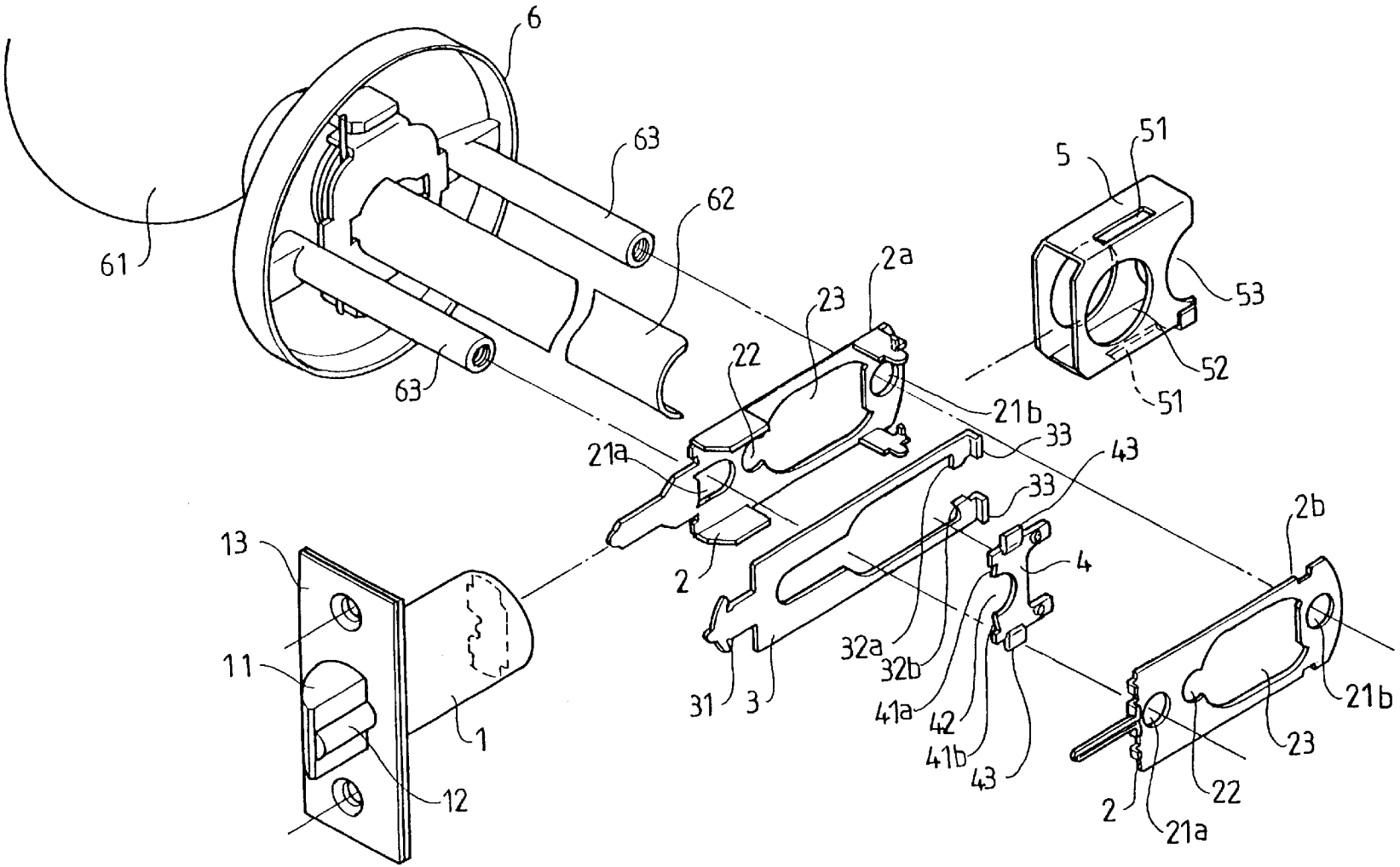
FIG. 1 is an exploded perspective view of a first embodiment of a latch bolt mechanism of a tubular lock in accordance with the present invention.
Figure 2:
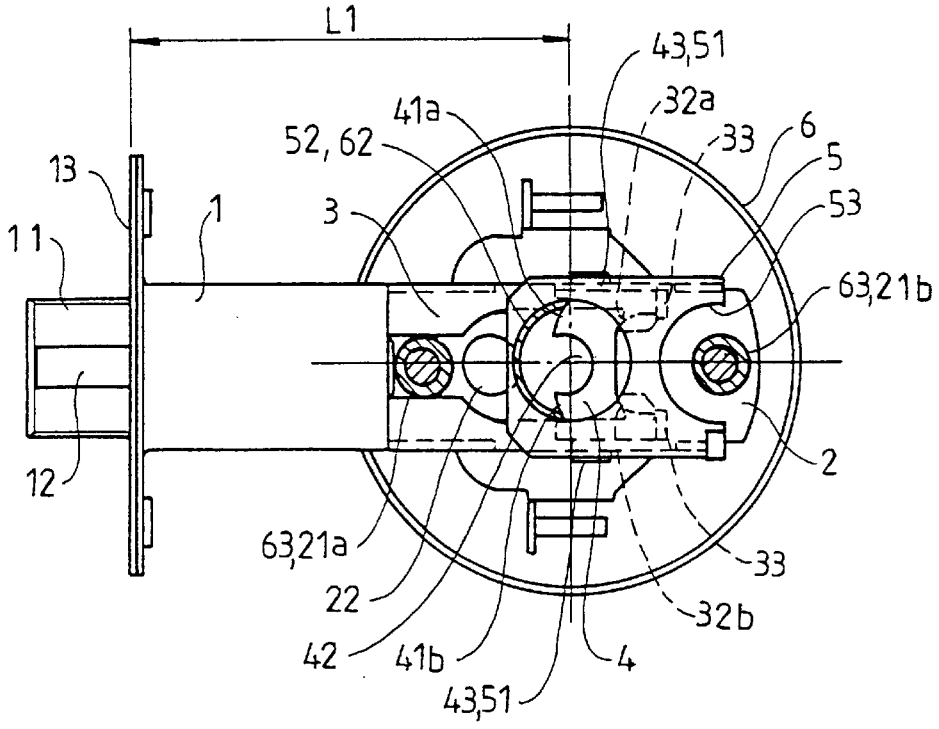
FIG. 2 is a sectional view of the latch bolt mechanism in a shorter backset state.

Referring to FIGS. 1 and 2, a latch bolt mechanism in accordance with the present invention generally includes a latch bolt housing 1, a plate assembly 2, an actuating plate 3, a follower plate 4, and an extension casing 5.

The latch bolt housing 1 is conventional and includes a latch bolt and an anti-theft pin 12. The latch bolt is driven by the actuating plate 3 so as to be retracted into a face place 13 (FIG. 5) to thereby allow opening of the door to which the latch bolt mechanism is mounted. When the actuating plate 3 is not actuated, the latch bolt 11 is biased by an elastic element (not shown) so as to be extended beyond the face plate 13 (FIG. 3) to thereby provide required latching function.

The plate assembly 2 includes a first plate 2*a* and a second plate 2*b* that are connected together to form a housing or the like so as to protect the actuating plate 3 and the follower plate 4 mounted therein. The first plate 2*a* and the second plate 2*b* are connected to an inner end face of the latch bolt housing 1. The first plate 2*a* and the second plate 2*b* include aligned first positioning holes 21*a* and 21*b*, aligned second positioning holes 22, and openings 23 through which a spindle 62 of a lockset 6 extends. A doorknob 61 is movably connected to the spindle 62.

The actuating plate 3 includes an end having a connecting member 31 (such as a hook) for retracting the latch bolt 11. The other end of the actuating plate 3 includes an upper tooth 32*a* and a lower tooth 32*b*. When the latch bolt mechanism is adjusted to have a longer backset and when the spindle 62 of the lockset 6 turns, one of the teeth 32*a*, 32*b* is pressed by a lateral side of the spindle 62 (depending upon the turning direction of the spindle 62) for retracting the latch bolt 11. Each tooth 32*a*, 32*b* of the actuating plate 3 further includes a block 33 formed thereon.

The follower plate 4 is in intimate contact with the actuating plate 3 and bears against the blocks 33. The follower plate 4 includes two teeth 41*a* and 41*b*. When the latch bolt mechanism is adjusted to have a shorter backset and when the spindle 62 of the lockset 6 turns, one of the teeth 41*a*, 41*b* is pressed by the spindle 62 (depending upon the turning direction of the spindle 62), which, in turn, presses against one of the teeth 32*a*, 32*b* for retracting the latch bolt 11. The follower plate 4 further includes a notch 42 through which one of two mounting posts 63 of the lockset 6 extends. The follower plate 4 further includes upper and lower blocks 43.

The extension casing 5 is mounted around an inner end of the plate assembly 2 and movable longitudinally relative to the plate assembly 2. The extension casing 5 includes upper and lower slots 51 in top and bottom sides thereof, respectively. The slots 51 receive the blocks 43 of the follower plate 4, respectively. The slots 51 have a length longer than that of the blocks 43 to thereby allow relatively movement between the extension casing 5 and the follower plate 4. The extension casing 5 includes a first hole 52 and a second hole 53 through which the spindle 62 of the lockset 6 is selectively extended. Further, the second hole 53 allows extension of one of the mounting post 63.

Figure 3:
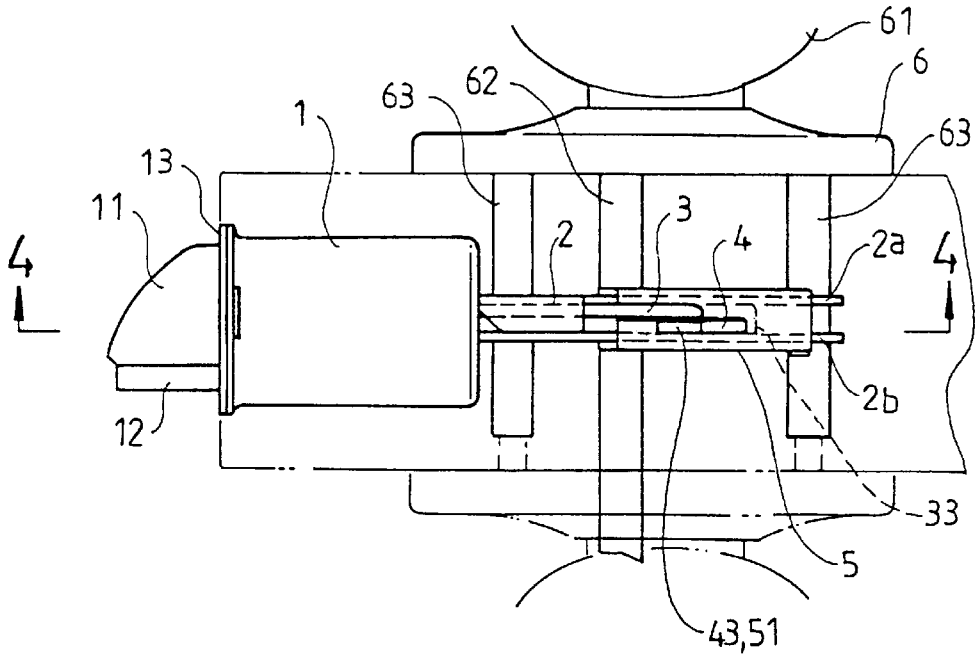
FIG. 3 is a top view of the latch bolt mechanism in FIG. 2.
Figure 4:
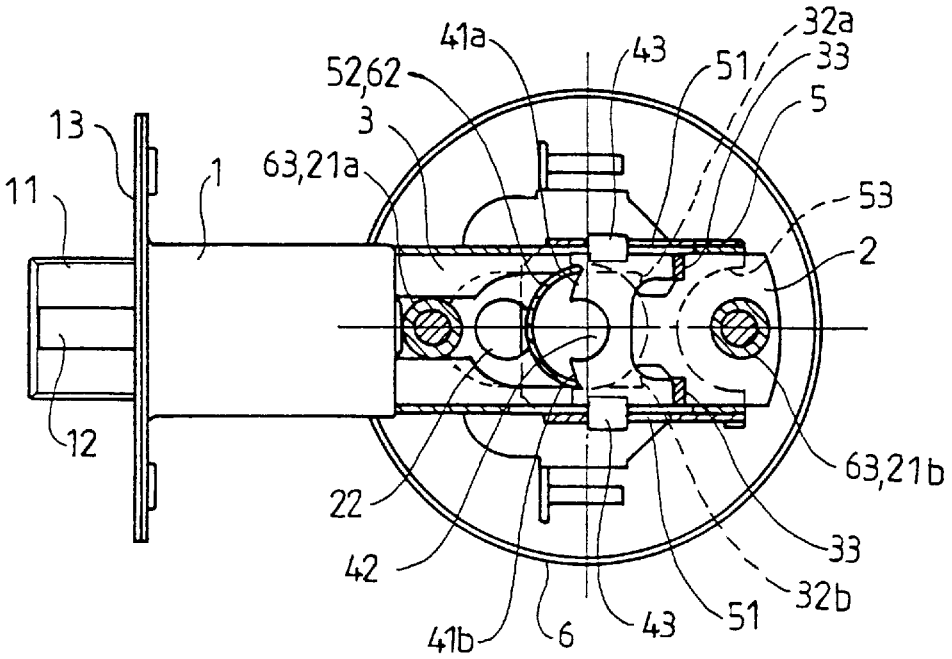
FIG. 4 is a sectional view taken along line 4—4 in FIG. 3.

Referring to FIGS. 2 through 4, when used with a shorter backset L1, the extension casing 5 is mounted to the inner end of the plate assembly 2 far away from the latch bolt housing 1. One of the two mounting posts 63 of the lockset 6 is extended through the first positioning holes 21*a* of the plate assembly 2 and the other mounting post 63 is extended through the positioning holes 21*b* of the plate assembly 2 and the second hole 53 of the extension casing 5. The spindle 62 of the lockset 6 is extended through the openings 23 of the plate assembly 2 and the first hole 52 of the extension casing 5. Two lateral sides of the spindle 62 press against the teeth 41*a* and 41*b* of the follower plate 4, respectively, and the follower plate 4 presses against the blocks 33 of the actuating plate 3.

Figure 5:
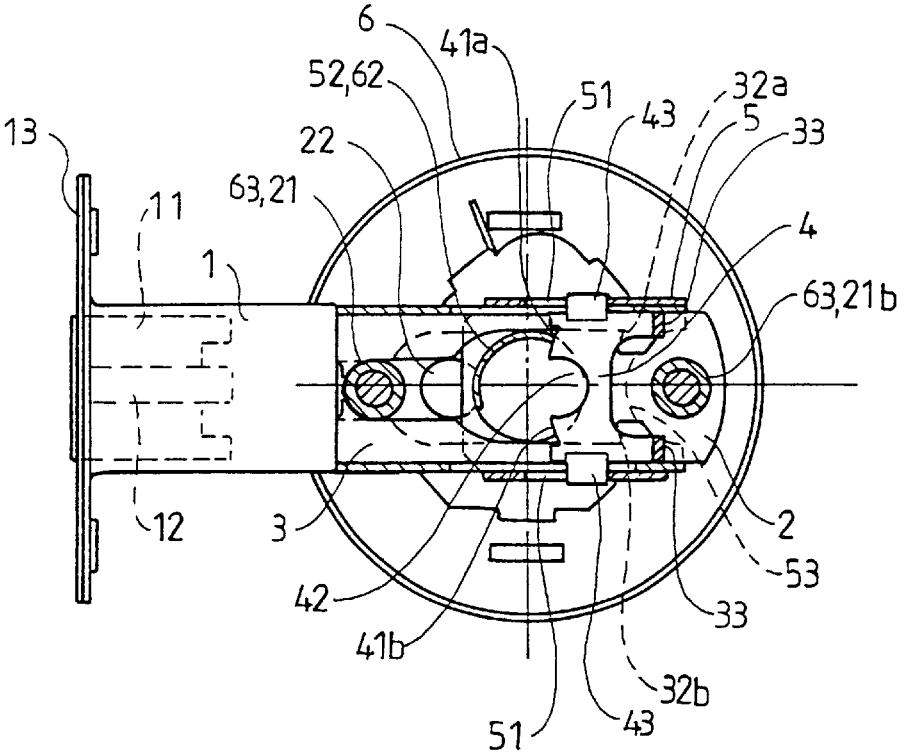
FIG. 5 is a view similar to FIG. 4, illustrating unlatching operation of the latch bolt.

Referring to FIG. 5, when the spindle 62 of the lockset 6 turns, one of the teeth 41*a,* 41*b* is pressed by the spindle 62, which, in turn, presses against one of the teeth 32*a,* 32*b* of the actuating plate 3 for retracting the latch bolt 11.

Figure 6:
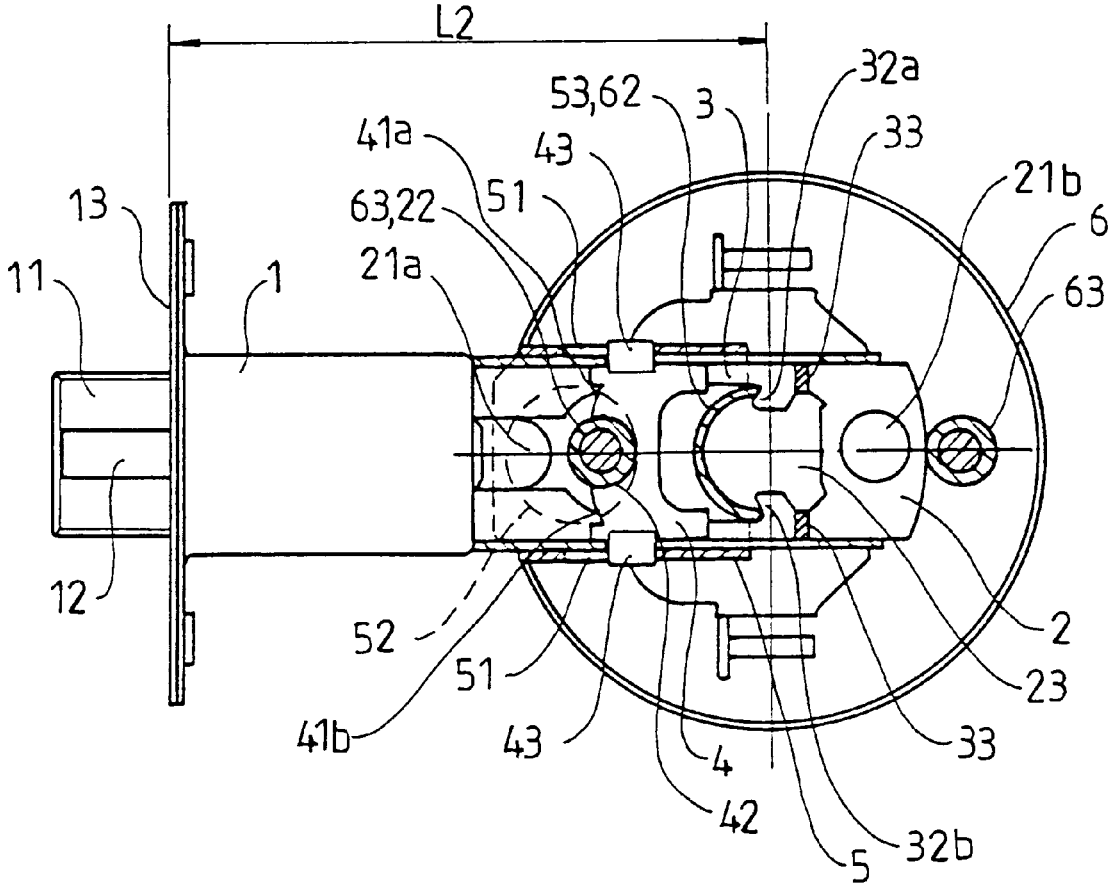
FIG. 6 is a view similar to FIG. 3, wherein the latch bolt mechanism is in a longer backset state.

Referring to FIG. 6, when used with a longer backset L2, the extension casing 5 is moved toward the latch bolt housing 1. The follower plate 4 leaves the blocks 33 of the actuating plate 3 to a position in which the notch 42 of the follower plate 2 is aligned with the second positioning holes 22 of the plate assembly 2, thereby allowing one of two mounting posts 63 of the lockset 6 to pass therethrough. The other mounting post 63 is located outside the plate assembly 2. The spindle 62 of the lockset 6 is extended through the openings 23 of the plate assembly 2 and the second hole 53 of the extension casing 5. Two lateral sides of the spindle 62 directly press against the teeth 32*a* and 32*b* of the actuating plate 3, respectively, and the follower plate 4 is more adjacent to the latch bolt housing 1 with the notch 42 thereof extended through by one of the mounting posts 63, as mentioned above. Thus, when the spindle 62 of the lockset 6 turns, one of the teeth 32*a,* 32*b* is directly pressed by the spindle 62 for retracting the latch bolt 11.

Figure 7:
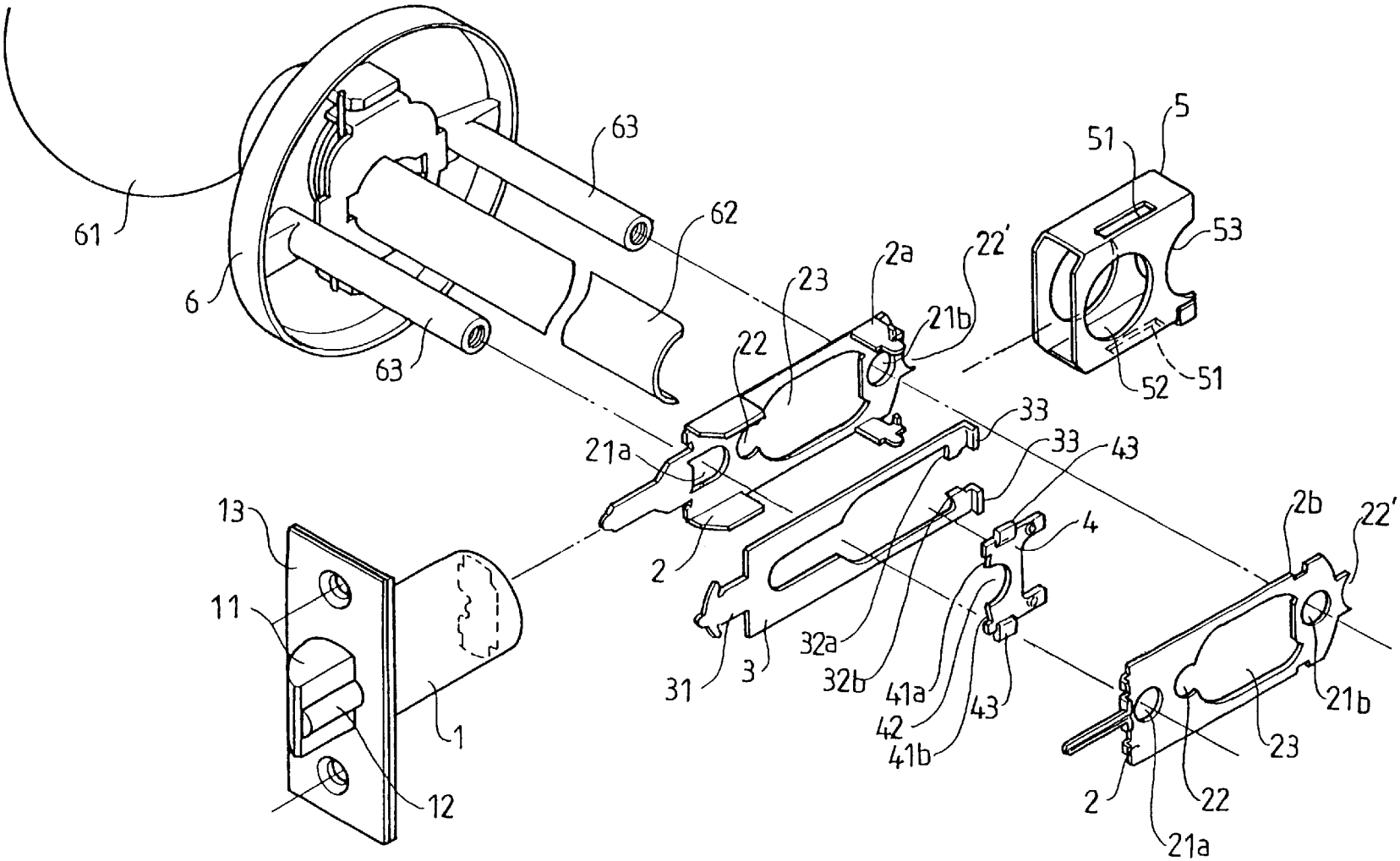
FIG. 7. is an exploded perspective view of a second embodiment of a latch bolt mechanism of a tubular lock in accordance with the present invention.

FIG. 7 illustrates a modified embodiment of the invention, the only difference between this modified embodiment and the above-mentioned embodiment is that each assembly plate 2*a,* 2*b* is longer and includes a second positioning hole 22' in the inner end thereof to allow passage of the other mounting post 63 of the lockset 6 when in the longer backset state.

According to the above description, it is appreciated that the backset of the latch bolt mechanism is adjusted easily by means of moving the extension casing 5 longitudinally relative to the plate assembly 2 toward or away from the latch bolt housing 1.

Although the invention has been explained in relation to its preferred embodiment as mentioned above, it is to be understood that many other possible modifications and variations can be made without departing from the scope of the invention. It is, therefore, contemplated that the appended claims will cover such modifications and variations that fall within the true scope of the invention.

What is claimed is:

1. A latch bolt mechanism of a tubular lock, comprising:

a latch bolt housing having a latch bolt mounted therein, the latch bolt being movable between a first position extended beyond a face plate and a second position retracted into the face plate, the latch bolt including an inner end;

two plates connected together and mounted to the inner end of the latch bolt, each of the plates including two first positioning holes, a second positioning hole, and an opening, the first positioning holes, the second positioning holes, and the openings of the plates being aligned with each other, respectively;

an actuating plate including a first end operably connected to the latch bolt and a second end, the second end of the actuating plate including a first tooth and a second tooth, each of the first tooth and the second tooth of the actuating plate including a block formed thereon;

an extension casing mounted around the plates and movable between a first position adjacent to the latch bolt housing and a second position distal to the latch bolt housing, the extension casing including a first hole, a second hole, a top side, and a bottom side, each of the top side and the bottom side of the extension casing including a slot;

a follower plate including an upper block and a lower block received in the slots of the extension casing, respectively, the follower plate including a first tooth and a second tooth, the follower plate having a side that presses against the actuating plate, the follower plate further including a notch.

2. The latch bolt mechanism as claimed in claim 1, wherein the notch of the follower plate is extended through by one of two mounting post of the tubular lock when the latch bolt mechanism is in a shorter backset state.

3. The latch bolt mechanism as claimed in claim 1, wherein each of the plates include a further positioning hole through which one of two mounting post of the tubular lock extends when the latch bolt mechanism is in a longer backset state.

* * * * *